US006679381B1

(12) United States Patent
Bush

(10) Patent No.: US 6,679,381 B1
(45) Date of Patent: Jan. 20, 2004

(54) ONE HAND OPENING CHILD RESISTANT BLISTER PACK CONTAINER

(75) Inventor: Randall G. Bush, Evansville, IN (US)

(73) Assignee: Rexam Medical Packaging, Inc.., Evansville, IN (US)

( * ) Notice: Subject to any disclaimer, the term of this patent is extended or adjusted under 35 U.S.C. 154(b) by 38 days.

(21) Appl. No.: 09/883,559

(22) Filed: Jun. 18, 2001

(51) Int. Cl.[7] ..... B65D 83/04; B65D 75/00; B65D 6/28

(52) U.S. Cl. ..... 206/531; 206/532; 206/815; 220/4.23

(58) Field of Search ..... 206/531, 214, 206/3, 532, 1.5, 815, 204, 404; 220/263, 324, 315, 326, 4.22, 4.23; 70/80; 292/252

(56) References Cited

U.S. PATENT DOCUMENTS 4,048,051 A 9/1977 Gretz
4,511,032 A * 4/1985 Bush ..... 206/531
4,576,307 A 3/1986 Frydenberg
4,615,464 A 10/1986 Byrns
5,033,634 A 7/1991 Batchelor et al.
5,076,460 A * 12/1991 Hussell ..... 220/324
5,109,984 A * 5/1992 Romick ..... 206/531
5,346,069 A 9/1994 Intini
5,740,938 A 4/1998 Hofmann et al.
5,799,821 A * 9/1998 Lambelet et al. ..... 206/531
5,878,878 A 3/1999 Wu

* cited by examiner

*Primary Examiner*—Mickey Yu
*Assistant Examiner*—Gregory Pickett
(74) *Attorney, Agent, or Firm*—James E. Cole; John F. Salazar; Middleton Reutlinger

(57) ABSTRACT

A blister pack container having child resistant characteristics yet, which can be opened with one hand. The container has a top tray and a bottom tray preferably connected by a hinge. The top and bottom trays each have a tab extending therefrom. Each of the tabs has at least one aperture through which a button passes and locks the container in a closed position. The finger pads can be unlocked with an inward and downward force thereby opening the container.

15 Claims, 4 Drawing Sheets

ONE HAND OPENING CHILD RESISTANT BLISTER PACK CONTAINER

BACKGROUND OF THE INVENTION

1. Technical Field of the Invention

The present invention relates to a Blister Pack Container. More particularly the invention relates to a child resistant blister pack container, which is operable by one hand.

2. Description of the Related Art

Various types of containers are available for storing pharmaceutical products and providing patient aid in administering drugs. For example, containers can be helpful with complex therapeutic regimens by having indicia telling a patient which days and/or times to take various pills. Many types of containers have safety mechanisms to prevent children from accessing the drugs contained therein. Despite these attempts, drugs meant for adults accidentally poison numerous persons of tender years each year. On the other hand, if the storage containers are too difficult to open, some people are excluded from using them. For example, blister packs may include a thin substrate of peelable nonrupturable plastic as a child resistant means. The substrate may have a grasping tab for removing the nonrupturable layer and exposing a rupturable layer. However, these are often difficult to use even for adults and some containers have no means of providing tamper indication.

One container, shown in U.S. Pat. No. 4,511,032 to Bush, shows a child resistant safety container. The container is made of molded plastic and has a first tray member and a second tray member joined by a pliable hinge. The container requires that two dissimilar movements are made such that one tray member is partially rotated in a direction different from the second tray member. Although this container provides some child resistant features, it requires two hands to use: one hand to hold the first tray member and one hand to twist the second tray member relative to the first tray member.

U.S. Pat. No. 4,576,307 to Frydenburg teaches a container having separable elements held together by a sliding latch. The container is comprised of first and second portions moveable between open and closed positions. The first portion has a rail with post and gaps in alignment with the rail. The second portion has posts which align with the gaps in the rail when the container is in a closed position. To maintain the container in a closed position, a slide closure is located on the rail for holding the posts of the second portion in alignment with the rail of the first portion.

U.S. Pat. No. 5,740,938 to Hofmann et al. teaches a safety container which may be used for blister packs. The container has a plurality of latches located around its perimeter. All the latches must be simultaneously be depressed in order to open the container.

In view of the deficiencies in the known child proof safety closures it is apparent that a pharmaceutical container is needed having child resistant characteristics as well as being easy to open, preferably through the use of one hand.

SUMMARY OF THE INVENTION

It is an object of the present invention to provide a blister pack container.

It is a further objective of this invention to have a blister pack container with child resistant characteristics.

It is still a further objective of this invention to have a blister pack container with child resistant characteristics, which may be opened with one hand.

It is still an even further objective of this invention to have a blister pack container with child resistant characteristics, which may be opened with one hand, and when used in conjunction with a blister pack provides a for tamper indication.

More particularly the present invention provides child resistant blister pack container, comprising a top tray rotatably hinged to a bottom tray, a first tab extending outward from the top tray, a second tab extending outward from the bottom tray, wherein the first tab has a button and an aperture formed thereon and wherein the second tab has a button and an aperture formed thereon, and the first aperture on the first tab receives the button from the second tab and the aperture on the second tab receives the button on the first tab when the container is in the closed position. Also, the button on the first and second tab has a retaining ledge, the retaining ledge on the button of the first tab contacts the second tab and the retaining ledge on the button on the second tab contacts the first tab when the container is in the closed position. This feature is possible because the first tab and the second tab extend from vertically aligned walls of the top tray and the bottom tray. Moreover, the first tab and the second tab each have at least one aperture aligned with the button of the first tab and the second tab.

The child resistant blister pack container has a hinge allowing rotation in a first plane and a limited rotation along a second transverse plane. The hinge is formed of a temporarily deformable plastic and provides a spring bias. This spring bias returns the top tray and bottom tray to alignment when there is limited rotation along the second transverse plane. The child resistant blister pack container is opened by rotating the top tray and the bottom tray in opposite directions along the second transverse plane of the hinge thereby disengaging the button of the first tab and second tab from the aperture of the second tab and first tab, respectively. Next the top and bottom trays are rotated along the first plane of rotation to access the interior of the container. The child resistant blister pack container has a plurality of dispensing holes on the bottom tray. The bottom tray may also have a plurality of retaining tabs along the inner walls.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
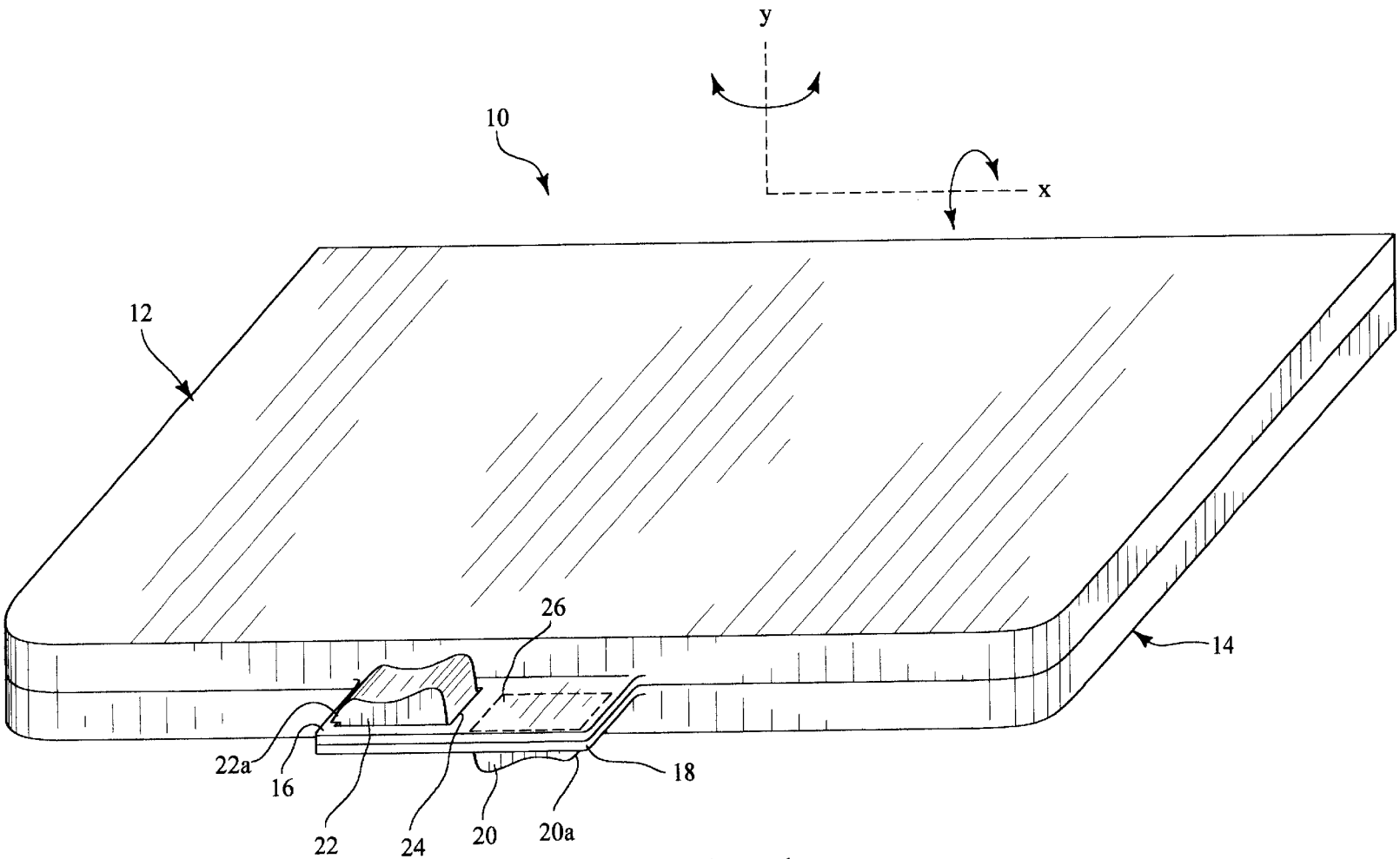
FIG. 1 shows a perspective view of the One Hand Opening Child Resistant Blister Pack Container of the present invention.
Figure 6:
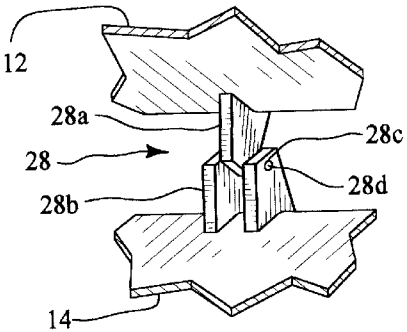
FIG. 6 shows a perspective view of an alternative hinge of the present invention; and, FIG. 7 shows a perspective view of a preferred embodiment of the blister pack of the present invention in the open position.
Figure 5:
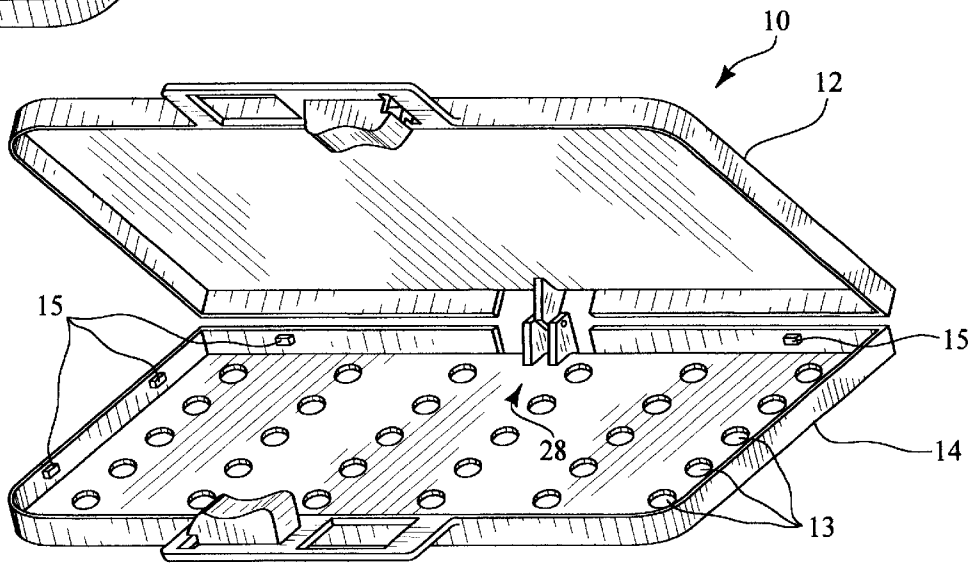
FIG. 5 shows a perspective view of an alternative embodiment of the blister pack container of the present invention in the open position having dispensing holes.

Referring initially to FIG. 1, a perspective view of the one hand child resistant blister pack container 10 is shown comprising a top tray 12 and a bottom tray 14. The top tray 12 and bottom tray 14 are preferably made of molded plastic, such as polypropylene, polyethylene, or other plastics, and are generally rectangular in shape, although various sizes can be used such that a blister pack fits within the container 10. The size of the top and bottom trays 12 and 14 can vary depending on the size of the blister pack prescribed. Tray 12 preferably has four walls which are connected by a top surface to form an upper half of an enclosure while tray 14 has four walls connected by a bottom surface to form a lower half of an enclosure. However as shown in FIG. 5, tray 14 may have a plurality of dispensing holes 13 located in the bottom surface. The dispensing holes 13 can be aligned with the blisters of a blister pack such that pharmaceuticals can be dispensed therethrough. In other words, the blister pack is in supply communication with the dispensing holes of tray 14.

Top and bottom trays 12 and 14 have substantially identical perimeters so that in a closed position the trays 12 and 14 align forming a full enclosure for holding a blister pack (not shown). It should be-understood by one skilled in the art that the trays 12 and 14 can vary in size and shape in accordance with the type of blister pack necessarily being used.

Figure 7:
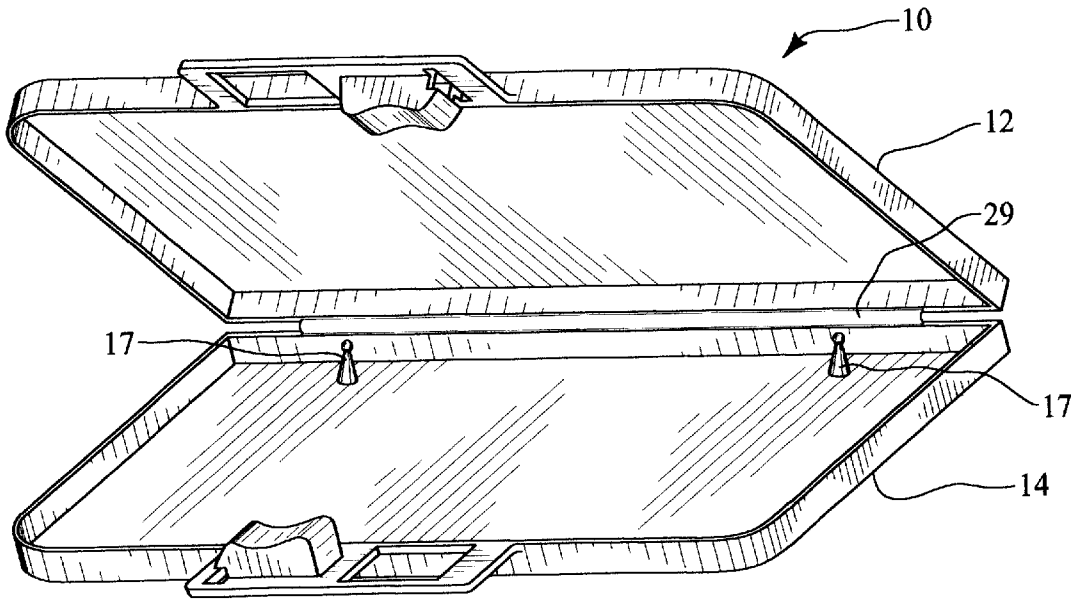

As best shown in FIG. 7, the top tray 12 and bottom tray 14 are operably connected by a living hinge 29. The living hinge 29 is preferably made of molded plastic and integrally formed with the top tray 12 and bottom tray 14. The hinge 29 allows a pivotal rotation along a first plane and limited pivotal rotation in a transverse plane. The second transverse plane is defined for purposes of this application as rotation about the y-axis as shown in FIG. 1. The plastic material is slightly deformable such that it allows limited rotation, in the transverse plane, of the top tray 12 relative to the bottom tray 14. As the top and bottom trays 12 and 14 are rotated in opposite directions about the y-axis, spring bias is provided by the resilient characteristics of the hinge 29 causing the top and bottom trays 12 and 14 to spring back to an aligned position once buttons 20 and 22 pass through apertures 26 and 24 respectively.

The living hinge 29 may be a strip of plastic or some other deformable material thus allowing rotation of the top and bottom trays 12 and 14 in a first and second limited direction. The hinge 29 may be continuous as depicted in FIG. 7 or may only be a segmented portion thereof, depending on the desired stiffness or resistance to rotation. However, many differing designs of a living hinge may be utilized and are considered to be within the scope of the present teaching. The deformation of hinge 29 biases the top and bottom trays 12 and 14 to either a substantially open or closed position. The living hinge 29 may extend across a length of adjacent sides of the top tray 12 and bottom tray 14 and may be unitarily constructed with the top and bottom trays 12 and 14. The hinge 29 may vary in length but the longer the length of the hinge 29, connecting the top and bottom trays 12 and 14, the thinner the construction of the hinge and vice-versa.

Figure 2:
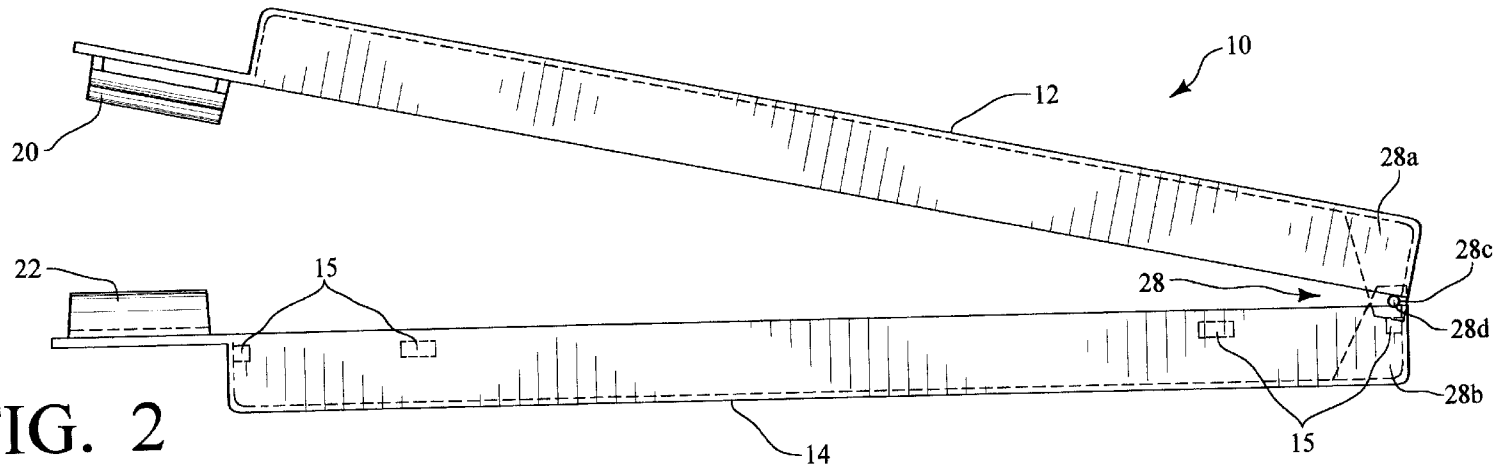
FIG. 2 shows a side view of an alternative embodiment present invention showing the hinge structure.
Figure 4:
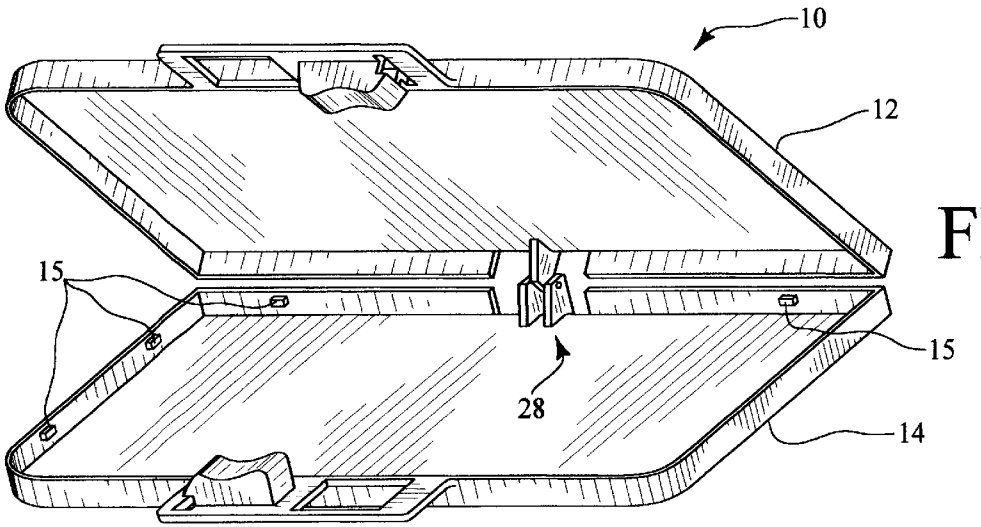
FIG. 4 shows a perspective view of an alternative embodiment of the blister pack container of the present invention in the open position.

Alternatively, as shown in FIGS. 2 and 5, the top tray 12 and bottom tray 14 are connected by a hinge 28, having a bottom tray 14 and comprising first and second hinge arms **28*b* in a spaced configuration. Top tray 12 has a mating hinge arm 28*a* which fits between first and second hinge arms 28*b*. Each of the hinge arms 28*a* and 28*b* has an alignment hole 28*c* for receiving a hinge pin 28*d*. Each of the hinge arms 28*a* and 28*b*** have a trapezoidal shape although the shape is not limited to trapezoidal.

Preferably, as shown in FIG. 7, the blister pack of the present invention comprises a plurality of posts 17 extending upwardly from the inside of the bottom tray 14. Each post may have a protuberance on top the post. The protuberances and posts 17 can be preferably used to attach or secure one or more blister packs (not shown) within the container 10. Alternatively shown in FIGS. 2 and 5 are a plurality of retaining tabs 15 spaced around the inside walls of bottom tray 14 for holding a blister pack in place. As a blister pack is placed inside the container 10 it is slightly deformed such that it can be placed beneath the retaining tabs 15. Then when the blister pack is released back to its normal shape and expands the outer edges of the blister pack move beneath the retaining tabs 15. This allows the tabs 15 to hold the blister pack in a proper position. These embodiments can be used with either hinge design and are not limited to the configurations shown herein.

FIG. 1 also shows tabs 16 and 18. Tab 16 extends from first tray 12 while tab 18 extends from second tray 14. Tabs 16 and 18 are also preferably formed of molded plastic, such as polypropylene, and are integrally formed with the first tray 12 and the second tray 14. Tabs 16 and 18 preferably extend from the same side of each tray such that they are both aligned when the container is in a closed position.

Figure 3:
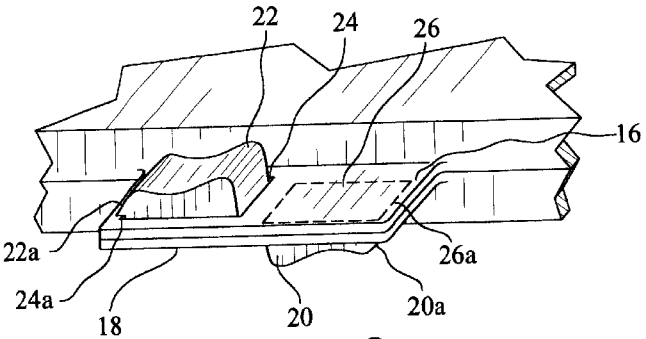
FIG. 3 shows a view of the tabs and buttons of the blister pack of FIG. 1.

Referring now to FIG. 3, tabs 16 and 18 are shown in a closed configuration. Within first and second tabs 16 and 18 are apertures 24 and 26. Apertures 24 and 26 are aligned with finger pads 22 and 20 respectively allowing container 10 to lock in a closed position.

Referring now to FIGS. 1 and 3, buttons 22 and 20 are shown. Buttons 20 and 22 are integral with tabs 16 and 18 by a resilient yet deformable plastic, such as polyethylene or polypropylene. Button 20 depends from tab 16 while button 22 extends upward from tab 18. When the container 10 is placed in the closed position, retaining ledge **20*a* extends over aperture 26 wall 26*a* while retaining ledge 22*a* extends over aperture 24 wall 24*a*. Buttons 22 and 20 are preferably made of molded plastic and can be integrally formed with top tray 12 and bottom tray 14. Buttons 22 and 20 also have the characteristic of being movable relative to tabs 16 and 18 respectively. For instance, as top tray 12 rotates in the second transverse plane relative to bottom tray 14, button 20 slides relative to second tab 18 because finger pad 20 is attached to first tab 16. On the other hand, button 22 slides relative to first tab 16 because button 22 is attached to second tab 18**.

To access the interior of the container 10, the container 10 must be opened. In order to open container 10, a user may apply a horizontally inward force to button 20 and 22 with a one hand pinching motion. As the inward force is applied the hinge 28 will temporarily deflect allowing rotation in a second transverse plane which also allows the button retaining ledges **22*a* and 20*a* to move to an unlocked position, within the bounds of apertures 24 and 26. Then a force is applied to buttons 22 and 20 which pushes buttons 22 and 20 through apertures 24 and 26 causing hinge 28 rotation in a first plane. Once the buttons 22 and 20 pass through apertures 24 and 26, the spring bias of the hinge 28 causes the top tray 12 and bottom tray 14 to return to their proper alignment as the top tray 12 and bottom tray 14 rotate in the first plane of hinge 28. When the container 10 is in an open position and a new blister pack (not shown) is placed in second tray 14 so that the blister pack is held in place by the plurality of retaining tabs 15. Finally, container 10 is closed by rotating the first and second trays in the first pivotal plane and causing buttons 20 and 22 to move through apertures 24 and 26** thus locking the container in a closed position. When the blister pack has a rupturable layer through which the medicine is dispensed, this may be used in conjunction with the dispensing holes as a form of tamper indication.

To summarize, the present invention provides a one hand opening child resistant blister pack container. The container comprises a top tray and bottom tray operably connected, preferably in a hinged manner. Each tray has a button and an aperture through which an opposing button passes to lock the container in a closed position. In addition each button is preferably movable relative to the tab members such that the container can be unlocked and opened using a single hand. The hinge allows limited rotation in a second transverse plane so that the container can be unlocked and rotation in a first plane about a hinge so that the container can be opened.

The invention may be embodied in various forms without departing from its spirit and essential characteristics. The described embodiments are not to be considered as restrictive.

I claim:

1. A child resistant blister pack container, comprising:

a top tray rotatably hinged to a bottom tray;

a first tab extending outward from said top tray;

a second tab extending outward from said bottom tray;

wherein said first tab has a button and an aperture formed thereon and wherein said second tab has a button and an aperture formed thereon;

each of said buttons having an upper curvilinear surface for primary rotation of said top tray and said bottom tray and an angled engagement surface for secondary rotation transverse to said primary rotation;

said bottom tray having a plurality of retaining tabs and dispensing holes;

wherein a hinge allows rotation in a first plane and limited rotation through a second transverse plane;

wherein said container is opened by squeezing said buttons of said first and second tabs first inward in said second transverse plane and substantially normal to said second transverse plane.

2. The child resistant blister pack container of claim 1 wherein said button on said first and second tabs have a retaining ledge, said retaining ledge on said button of said first tab contacting said second tab and said retaining ledge on said button of said second tab contacting said first tab when said container is in a closed position.

3. The child resistant blister pack container of claim 1 wherein said hinge is an elongated strip of deformable material connecting said top and bottom trays.

4. The child resistant blister pack container of claim 3 wherein said hinge provides a spring bias.

5. The child resistant blister pack container of claim 1 wherein said hinge comprises first and second hinge arms in a spaced configuration on said bottom tray, a mating hinge arm on said top tray, each of said hinge arms having an alignment hole for receiving a hinge pin.

6. The child resistant blister pack container of claim 1 wherein said container is opened by rotating said top tray and said bottom tray in opposite directions along said second transverse plane of said hinge.

7. A child resistant blister pack container, comprising:

a top tray rotatably hinged to a bottom tray;

a first tab extending outward from said top tray;

a second tab extending outward from said bottom tray;

wherein said first tab has a button and an aperture formed thereon and wherein said second tab has a button and an aperture formed thereon;

each of said buttons having an angled side engagement surface and an upper curvilinear engagement surface;

said first aperture on said first tab receiving said button from said second tab and said aperture on said second tab receiving said button on said first tab when said container is in the closed position;

wherein a hinge allows a rotation in a first plane and limited rotation along a second transverse plane;

wherein said button of said first tab has a retaining ledge extending through said second tab and said button of said second tab has a retaining ledge extending through said first tab;

wherein said container is opened by rotating said top tray and said bottom tray in opposite directions through said second transverse plane.

8. The child resistant blister pack container of claim 7 wherein said hinge is an elongated strip of deformable material connecting said top and bottom trays.

9. The child resistant blister pack container of claim 7, wherein said hinge comprises first and second hinge arms in a spaced configuration on said bottom tray, a mating hinge arm on said top tray, each of said hinge arms having an alignment hole for receiving a hinge pin.

10. The child resistant blister pack container of claim 7 wherein said hinge provides a spring bias.

11. The child resistant blister pack container of claim 7 further comprising a plurality of retaining tabs along inner walls of the bottom tray.

12. The child resistant blister pack container of claim 7 further comprising a plurality of posts extending from said bottom tray adjacent said hinge.

13. A child resistant blister pack container, comprising:

a top tray rotatably hinged to a bottom tray;

a first tab extending outward from said top tray;

a second tab extending outward from said bottom tray;

wherein said first tab has a button and an aperture formed thereon and wherein said second tab has a button and an aperture formed thereon;

each of said buttons having an angled side engagement surface and an upper curvilinear engagement surface;

said first aperture on said first tab receiving said button from said second tab and said aperture on said second tab receiving said button on said first tab when said container is in the closed position;

wherein a hinge allows a rotation in a first plane and limited rotation along a second transverse plane;

wherein said button of said first tab has a retaining ledge extending through said second tab and said button of said second tab has a retaining ledge extending through said first tab;

wherein said container is opened by rotating said top tray and said bottom tray in opposite directions through said second transverse plane;

wherein said hinge comprises an elongated strip of deformable material connecting said top and bottom trays.

14. The child resistant blister pack container of claim 13 wherein said hinge provides a spring bias.

15. A child resistant blister pack container, comprising:

a top tray rotatably hinged to a bottom tray;

a first tab extending outward from said top tray;

a second tab extending outward from said bottom tray;

wherein said first tab has a button and an aperture formed thereon and wherein said second tab has a button and an aperture formed thereon;

each of said buttons having an angled side engagement surface and an upper curvilinear engagement surface;

said first aperture on said first tab receiving said button from said second tab and said aperture on said second tab receiving said button on said first tab when said container is in the closed position;

wherein a hinge allows a rotation in a first plane and limited rotation along a second transverse plane;

wherein said button of said first tab has a retaining ledge extending through said second tab and said button of said second tab has a retaining ledge extending through said first tab;

wherein said container is opened by rotating said top tray and said bottom tray in opposite directions through said second transverse plane; and, a plurality of posts extending from said bottom tray adjacent a hinge.

* * * * *